US005113945A

United States Patent [19]

Cable

[11] Patent Number: 5,113,945

[45] Date of Patent: May 19, 1992

[54] FOAM/WATER/AIR INJECTOR MIXER

[75] Inventor: Brian Cable, Elkhart, Ind.

[73] Assignee: Elkhart Brass Mfg. Co., Inc., Elkhart, Ind.

[21] Appl. No.: 652,064

[22] Filed: Feb. 7, 1991

[51] Int. Cl.[5] ..... A62C 35/00

[52] U.S. Cl. ..... 169/15; 169/14

[58] Field of Search ..... 169/14, 15, 44

[56] References Cited

U.S. PATENT DOCUMENTS

| | | | |
|---|---|---|---|
| 2,003,184 | 5/1935 | Friedrich | 169/15 X |
| 2,106,043 | 1/1938 | Urquhart et al. | 169/15 X |
| 2,138,133 | 11/1938 | Betzler | 169/15 X |
| 2,183,561 | 12/1939 | Hamblin | 169/15 X |
| 2,418,858 | 4/1947 | Urquhart | 169/15 X |
| 2,577,451 | 12/1951 | Clemens | 169/15 |
| 2,769,500 | 11/1956 | Clifford | 169/15 |
| 2,990,885 | 7/1961 | Brazier | 169/15 X |
| 3,701,482 | 10/1972 | Sachnik | 169/15 X |
| 4,981,178 | 1/1991 | Bundy | 169/15 X |
| 4,989,675 | 2/1991 | Papavergos | 169/14 |

FOREIGN PATENT DOCUMENTS

| | | | |
|---|---|---|---|
| 796055 | 6/1958 | United Kingdom | 169/15 |

*Primary Examiner*—Margaret A. Focarino
*Assistant Examiner*—James M. Kannofsky
*Attorney, Agent, or Firm*—Thomas J. Dodd

[57] ABSTRACT

Firefighting apparatus specially adapted to deliver pressurized foam to a target surface. The apparatus includes a unique air injection mixer in which the air discharge nozzles are oriented at oblique angles to the stream flow. The aspirated air causes the foam to expand in the mixer without loss of force through generated turbulence to increase the pumping efficiency of the apparatus.

12 Claims, 6 Drawing Sheets

FOAM/WATER/AIR INJECTOR MIXER

FIELD OF THE INVENTION

This invention relates to injector/mixers, and will have special application to mixers of foam, air, and water in the fire fighting industry.

BACKGROUND OF THE INVENTION

Compressed Air Foam Systems (CAFS) have recently gained popularity with many different types of firefighting organizations. The reason is simple. Foams are more effective in both putting out and controlling the spread of most fires. Foams are also cheaper to use than simply dousing a fire with water and also save the building owner a considerable amount in water damage. Also foams come in many classifications which work efficiently against all of the common types of fires.

One problem which has been of great concern to users of CAFS is the creation of turbulence in the delivery line at a point just downstream of the air injection port. Since air must necessarily be injected into the line at some point to ensure proper expansion of the foam, the problem of turbulence needed to be solved, since the delivery of the foam was impeded due to energy loss.

All previous attempts at solving the turbulence problem failed to some degree. These attempts included air injection at right angles relative to the water/foam flow, air injection at oblique angles, and mixing in various so-called motionless mixers such as the labyrinth, the perforated plate, the orifice and the modified orifice. While these mixers reduced the turbulence in the line, significant energy loss still occurred with the resulting loss of pressure and throw distance at the nozzle end.

More information about the general principles of CAFS can be found in the attached report of the U.S. Department of Agriculture.

SUMMARY OF THE INVENTION

The injector/mixer of this invention includes an eductor positioned in flow communication between the water pump and the hose. The eductor includes ports for the introduction of foam solution and air into the water stream. Inside the central bore of the eductor is an insert which has a tapered bore and a plurality of peripheral holes in communication with the air injection port.

As the water flows through the tapered portion of the insert bore, a venturi-like effect is created. Injection of foam and air at the point where the bore tapers almost totally eliminates the turbulence in the line due to the increased velocity and lowered pressure of the stream through the tapered section of the bore. Mixing is also enhanced which results in more effective foam production.

As the water/foam/air mixture exits the eductor, the foam generated from the mixing passed through a flared connector, and then into the fire hose for delivery through a nozzle. Preferably, the foam is of the approximate consistency of shaving foam and is delivered through the nozzle with little energy loss due to turbulence.

Accordingly, it is an object of this invention to provide for a water/foam/air mixer which promotes efficient mixing delivers consistent foam solution to the nozzle.

Another object is to provide a water/foam/air mixer which reduces energy loss in the hose due to turbulence.

Another object is to provide a water/foam/air mixer which is efficient no matter what size and delivers predictable pressure and throw distance at the nozzle end.

Still another object is to provide a water/foam/air mixer which can be used with currently available firefighting equipment.

Still another object is to provide a water/foam/air mixer which may be efficiently used with all types of foam solutions and mixer ratios.

Other objects will become apparent upon a reading of the following description.

DESCRIPTION OF THE PREFERRED EMBODIMENTS

The preferred embodiments herein described are not intended to be exhaustive or to limit the invention to the precise forms disclosed. They are chosen and described to explain the principles of the invention and its application and practical use to enable others skilled in the art to utilize its teachings.

Figure 4:
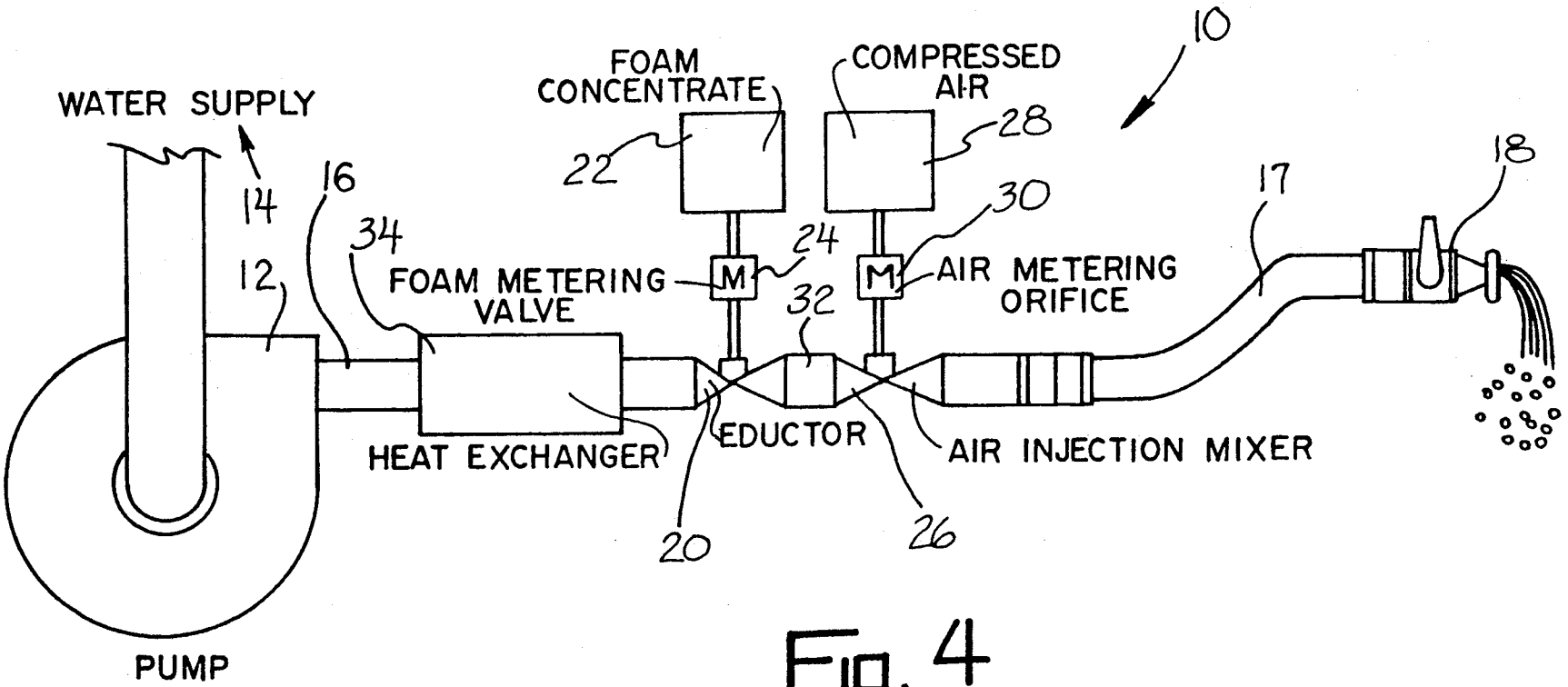
FIG. 4 is a schematic depiction of a firefighting apparatus utilizing the mixer of FIG. 1.
Figure 5:
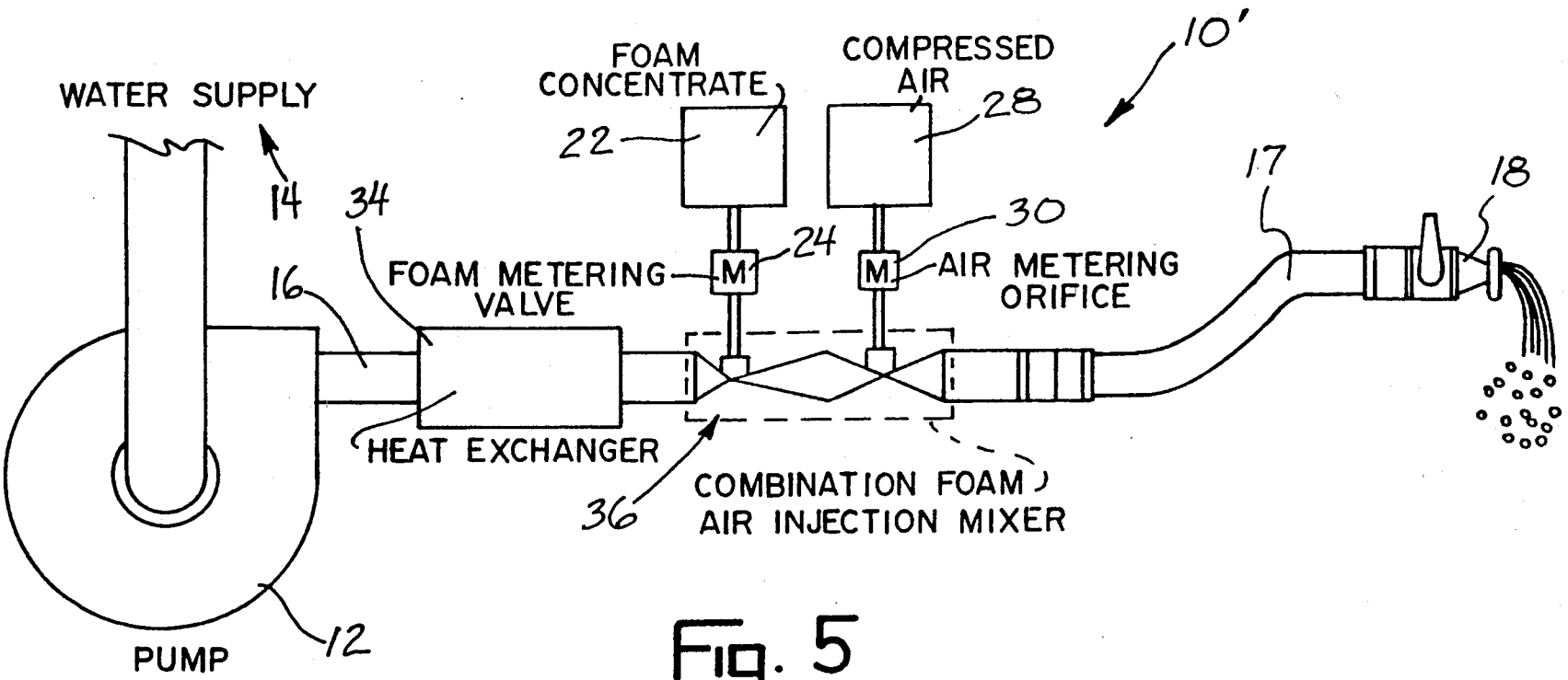
FIG. 5 is a schematic depiction of a firefighting apparatus utilizing the combination mixer of FIG. 3.
Figure 6:
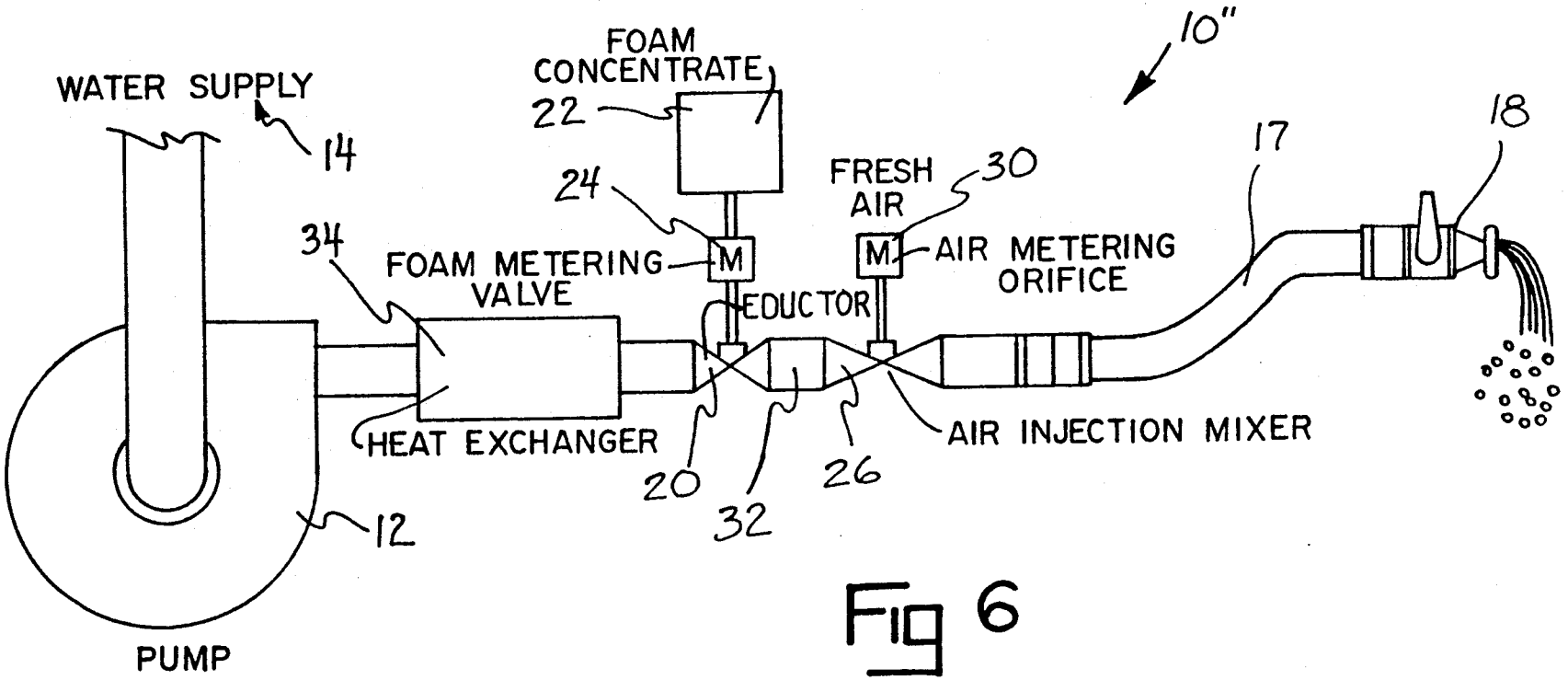
FIG. 6 is a schematic depiction of the apparatus of FIG. 4 but illustrating a naturally aspirated air mixer.

Referring first to FIGS. 4–6, reference numerals 10, 10', and 10'' refer generally to a firefighting apparatus with the delivery system shown in schematic form. Each apparatus 10 includes water supply 14 pump 12 conduit 16, fire hose 17 and discharge nozzle 18. The above description applies to nearly all firefighting vehicles in use today.

FIG. 4 illustrates the use of the current invention in combination with system 10. In this embodiment, an eductor 20 is connected in flow communication along conduit 16 and is connected to a supply of foam concentrate 22. The foam concentrate 22 may consist of any of the available foams which are used in fighting varying types of fires. A metering valve 24 is connected between foam supply 22 and eductor 20 to allow firefighters to visually observe that the specified concentration of foam is being introduced into the eductor 20.

An air injection mixer 26 is connected in flow communication to conduit 16 downstream of eductor 20. A supply of compressed air 28 is connected to mixer 26 and supplies pressurized air into conduit 16. An air metering orifice 30 is connected between air supply 28 and mixer 26 to ensure that the air pressure at the mixer 26 is kept at the proper level. Eductor 20 and mixer 26 are separated by an adapter 32 in this embodiment. Heat exchanger 34 is optionally placed between water supply pump 12 and eductor 20 to heat the water if desired.

System 10 operates to deliver foam under pressure through discharge nozzle 18 to fight various types of fires. As water is pumped through conduit 16 into eductor 20, a quantity of foam concentrate is continuously mixed into the water, with the exact quantity preset by the firefighter to be checked at metering valve 24.

The water/foam mixture passes under pressure from pump 11 through mixer 26, where aire is continuously injected into the stream in premeasured quantities metered by orifice 30. The air serves to expand the foam in the water, so that the stream exiting the discharge nozzle is of the approximate consistency of shaving foam.

The system 10' shown in FIG. 5 is virtually identical to the system 10 shown in FIG. 4, except that adapter 32 is not present, creating a combination water/foam/air/-mixer identified generally by numeral 36. The resulting foam at discharge nozzle 18 is much the same as that described above, with the process being virtually identical.

System 10" shown in FIG. 6 is also virtually identical to system 10, except that the air supply 28 has been replaced by a natural aspiration system which eliminates the air pump and simply vents metering orifice 30 to outside air. The process of foam making described above is identical except that instead of forcefully injecting air into the steam in conduit 16, air is introduced by natural suction of ambient air into eductor 26 as the stream passes at high speed. All three systems 10, 10', and 10" are capable of delivering expanded foam through discharge nozzle 18 to fight fires as described above.

Figure 1:
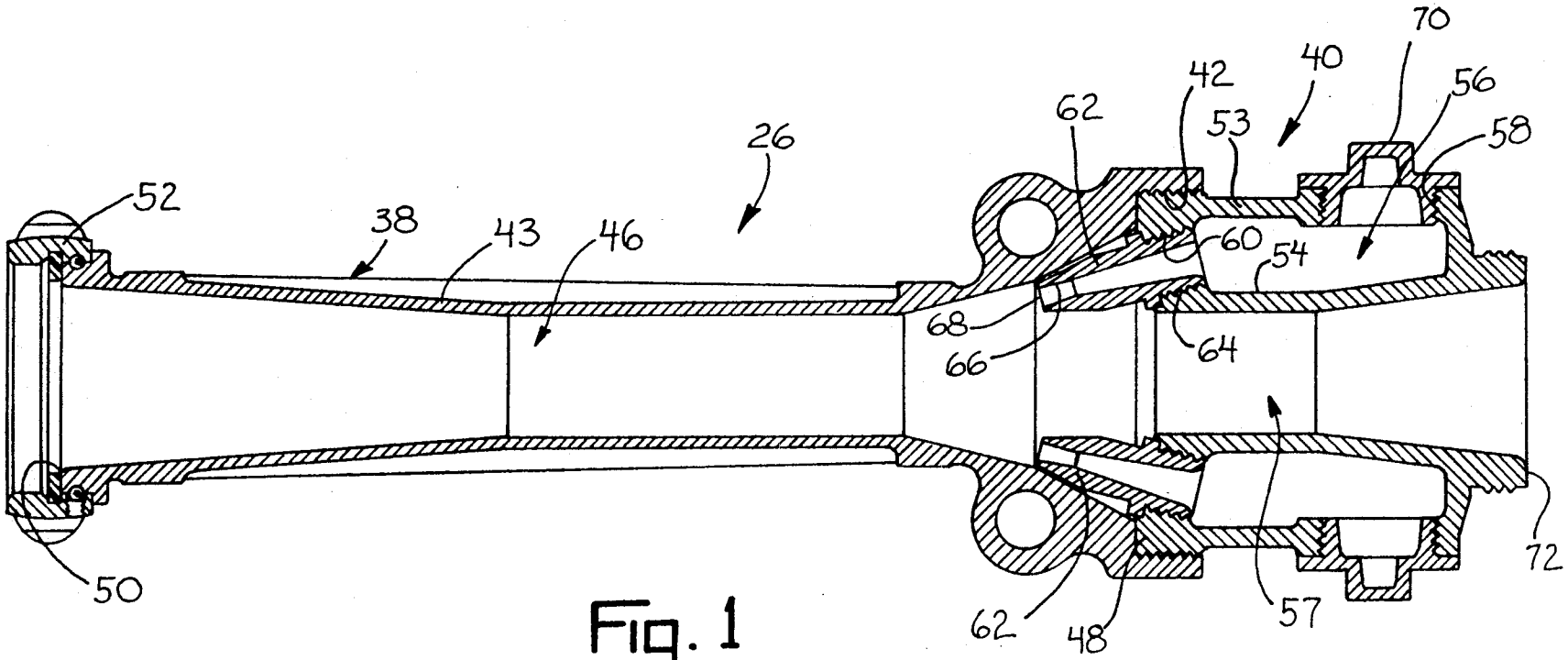
FIG. 1 is a sectional view of an air injection mixer constructed according to the principles of this invention.

FIG. 1 illustrates the air injection mixer 26 in detail. Mixer 26 as shown includes an elongated tube 38 which is detachably connected to an eductor body 40 at threads 42. Alternatively, tube 38 and body 40 may be of one-piece construction or may be permanently affixed, if desired.

Tube 38 is preferably formed of cast metal includes continuous side wall 43 which defines inner passageway 46 through which the flow stream passes. In the embodiment shown, passageway 46 is initially wide at the inlet end 48 of tube 38, gradually narrowing to a central point in the tube, then expanding again to a flared outlet end 50. It is understood that the passageway 46 can also be formed to be of continuous even diameter or some different configuration to provide for varying types of fluid flow through tube 38. The venturi type arrangement currently shown in FIG. 4 is but one configuration of tube 38 which will efficiently expand the foam/water mixture prior to its discharge. Tube 38 includes a swivel connector 52 of conventional type construction to allow mixer 26 to be connected in flow communication with conduit 16.

Body 40 is also preferably formed of cast metal, and, as shown, in FIG. 4, includes outer wall 53 and inner wall 54 which define a chamber 56 therebetween and a central passageway 57. Outer wall 53 has one or more air inlet ports 58 (two shown) which communicate with chamber 56. Chamber 56 communicates with tube passageway 46 through openings 60 (two shown). An air outlet nozzle 62 is fitted in each opening 60 and secured as by threads 64. Nozzle 62 as shown has a tapered opening 66 which terminates in an outlet 68 in direct communication with tube passageway 46. Caps 70 are removably secured over each air inlet port 58 to close the port when not in use.

Mixer 26 is utilized by connecting its downstream end 50 to firehose 17 through swivel connector 52, and its upstream end 72 to adapter 32 by conventional means. System 10 is then operated as described above. With caps 70 removed, pressurized air flows from air supply 28 through air inlet ports 58 and nozzles 62 into the stream of water and foam flowing through passageway 46. The influence of the flowing air causes the foam to expand as it continues its journey through conduit 16 until exiting through discharge nozzle 18. By positioning each nozzle 62 at an oblique angle relative to the flow path of the stream in passageway 46, turbulence in the stream due to forced air entry is virtually eliminated. This results in greater foam output at nozzle 18 when compared with other systems using an equal power pump 12.

Figure 2:
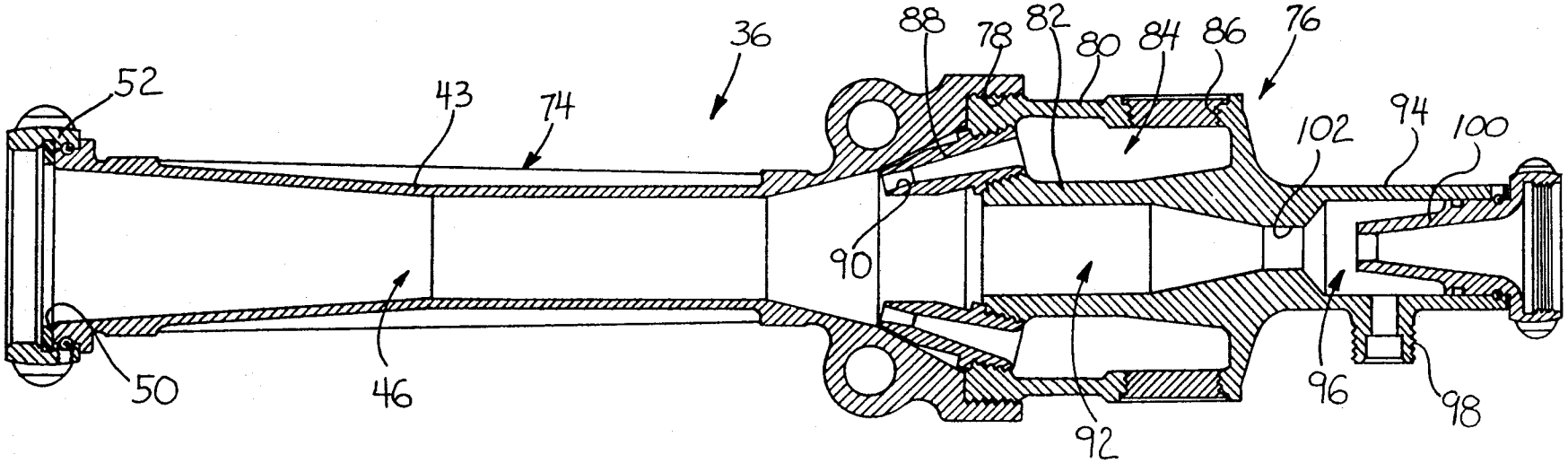
FIG. 2 is a sectional view of a combination water/-foam/air injection mixer.

FIG. 2 illustrates a combination mixer as referred to by reference numeral 36 in FIG. 5. Combination mixer 36 includes tube 74 which is of the same construction as the tube 38 of FIG. 1 and whose component parts and orifices are referred to by the above numbers. Combination mixer 36 also includes body 76 which is connected to tube 74 as by threads 78. Body 76, like mixer body 40 also includes inner and outer walls 80 and 82 respectively, which define inner chamber 84. One or more air inlet ports 86 (two shown) are formed in outer wall 82 and are in flow communication with chamber 84. Air outlet nozzles 88 (two shown) connect chamber 84 and air supply 28 with the stream of water/foam which flows through passageway 46. Each nozzle may have a tapered opening 90 as shown.

Body 76 defines central passageway 92 in flow communication with passageway 46 and conduit 16. Body 76 also includes an extension 94 having passageway 96 as shown. Foam inlet port 98 extends from extension 94 and allows communication between foam supply source 22 and passageway 96. A inlet tube 100 connects passageway 96 and conduit 16 in flow communication. The positioning of tube 100 in passageway 96 creates a venturi-like effect to draw foam concentrate from supply 22 into the stream by natural suction.

Passageway 92 may include narrowed neck portion 102 between body 76 and extension 94 to enhance the venturi effect and improve introduction of foam into the stream. Combination mixer 36, after installation at the noted place in system 10' functions to fight fires in the manner ascribed to system 10.

Figure 3:
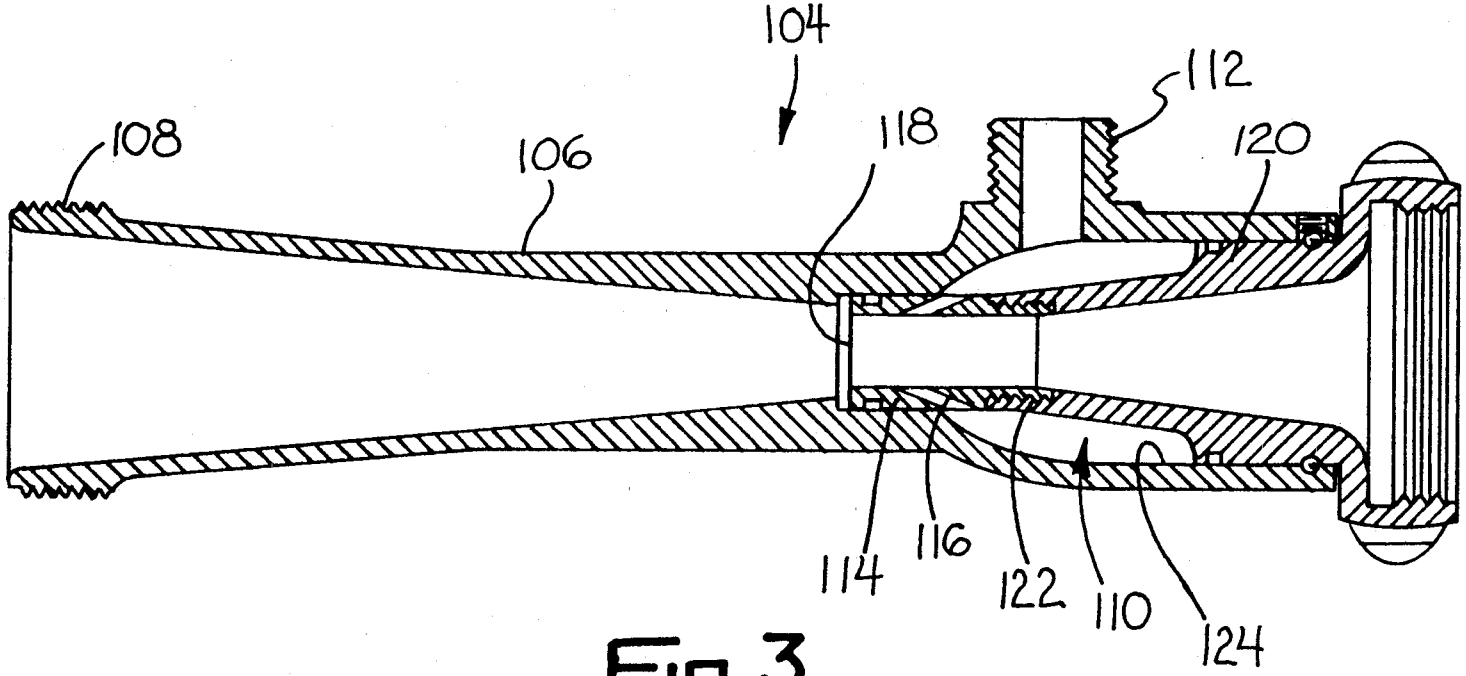
FIG. 3 is a sectional view of a modified air injection mixer according to the principles of this invention.

FIG. 3 illustrates a smaller (2.5) diameter air injection mixer 104, which is installed at the same place in system 10 as mixer 26. Mixer 104 includes outwardly flared tube 106 which is connected via threads 108 to firehose 17. Tube 106 includes an inlet chamber 110 as shown and one or more air inlet ports 112 (one shown) which communicate with chamber 110.

Nozzle insert 114 has one or more air openings 116 (two shown) which terminate at a discharge end 118 adjacent the narrowest section of tube 106. An inwardly flared connector 120 is connected to nozzle insert 114 as by threads 122. When so connected, connector 120 and nozzle insert 114 together with tube 106 form a distinct air chamber 124 as shown. Mixer 104 operates similarly to mixers 26 and 36 described above and may be used in any of the systems 10, 10', or 10" shown.

It is understood that the above description does not limit the invention to the details described, but that it may be modified within the scope of the following claims.

I claim:

1. Firefighting apparatus comprising a conduit, pump means connected to said conduit for delivering a supply of pressurized fluid through said conduit to a discharge nozzle, said pressurized fluid containing a predetermined quantity of a foaming agent, an eductor tube positioned along and in flow communication with said conduit, said eductor tube including an air inlet port in flow communication with a stream of pressurized air, and an air outlet nozzle positioned in the eductor tube in flow communication between said inlet portion and a through passageway of said eductor tube through which said pressurized fluid flows, said air outlet nozzle oriented at an oblique angle relative to a flow path of said fluid through said passageway, and means for introducing air into said flow path through said air outlet nozzle wherein said foaming agent expands into said pressurized fluid prior to discharge through said discharge nozzle.

2. Firefighting apparatus of claim 1 wherein said air outlet nozzle is removably secured to said eductor tube.

3. Firefighting apparatus of claim 1 wherein said air outlet nozzle has an inlet and an outlet connected in flow communication by an air passage, said passage having dimensions which narrow from said inlet to said outlet.

4. Firefighting apparatus of claim 1 and heater means connected to said conduit between said pump means and said eductor tube, said heater means for warming said pressurized fluid prior to its entering the eductor tube.

5. Firefighting apparatus of claim 1 and a second air inlet port located in said eductor tube spaced from said first mentioned air inlet port, and a second air outlet nozzle in flow communication with said second air inlet port and said stream of pressurized air.

6. Firefighting apparatus of claim 1 wherein said means for introducing includes an air injection pump.

7. Firefighting apparatus of claim 1 wherein said eductor tube passageway gradually widens from a point past said air outlet nozzle to an outlet of the eductor tube.

8. Firefighting apparatus of claim 7 wherein said passageway tapers from a fluid inlet of said eductor tube to said point.

9. Firefighting apparatus of claim 8 wherein said eductor tube includes an elongated pipe, and a body detachably connected to said pipe, said body housing said eductor inlet and said air discharge nozzle.

10. Firefighting apparatus of claim 1, and a second eductor tube positioned in flow communication with said conduit between said pump means and said first mentioned eductor tube, said second eductor tube including a foam inlet port, and a foam outlet port in flow communication with said stream of pressurized fluid, and means for introducing said foaming agent into said stream of pressurized fluid through said foam inlet and outlet ports.

11. Firefighting apparatus of claim 10 wherein said second eductor tube is detachably connected to said first mentioned eductor tube upstream of said air outlet nozzle.

12. Firefighting apparatus of claim 11 wherein said second eductor tube includes an inlet port and an outlet port connected in flow communication by a passageway said outlet port of narrower dimensions than said inlet port.

* * * * *